US010704559B2

(12) United States Patent
Funakoshi et al.

(10) Patent No.: US 10,704,559 B2
(45) Date of Patent: Jul. 7, 2020

(54) VERTICAL PUMP AND UREA SYNTHESIS PLANT

(71) Applicant: MITSUBISHI HEAVY INDUSTRIES, LTD., Tokyo (JP)

(72) Inventors: Hiroshi Funakoshi, Tokyo (JP); Yasushi Ueda, Tokyo (JP); Akio Maeda, Tokyo (JP); Yasuhiro Koyama, Tokyo (JP); Hidetoshi Fukuta, Yokohama (JP); Masahide Ikunami, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/325,899

(22) PCT Filed: Nov. 9, 2017

(86) PCT No.: PCT/JP2017/040481
§ 371 (c)(1),
(2) Date: Feb. 15, 2019

(87) PCT Pub. No.: WO2018/131275
PCT Pub. Date: Jul. 19, 2018

(65) Prior Publication Data

US 2019/0211833 A1 Jul. 11, 2019

(30) Foreign Application Priority Data

Jan. 10, 2017 (JP) ..... 2017-002207
Jan. 10, 2017 (JP) ..... 2017-002208
Jan. 10, 2017 (JP) ..... 2017-002209

(51) Int. Cl.
*F04D 13/02* (2006.01)
*F04D 15/00* (2006.01)
(Continued)

(52) U.S. Cl.
CPC ..... *F04D 29/0416* (2013.01); *F04D 1/06* (2013.01); *F04D 1/066* (2013.01); *F04D 1/08* (2013.01);
(Continued)

(58) Field of Classification Search
CPC .... F04D 29/0416; F04D 13/02; F04D 29/426; F04D 29/086; F04D 15/00;
(Continued)

(56) References Cited

U.S. PATENT DOCUMENTS 5,522,701 A 6/1996 Nicklas et al.

FOREIGN PATENT DOCUMENTS

CN 200975360 Y * 11/2007
CN 103570588 A 2/2014
(Continued)

OTHER PUBLICATIONS

Machine translation for CN200975360 Y (Year: 2019).*
(Continued)

*Primary Examiner* — Huy Tram Nguyen
(74) *Attorney, Agent, or Firm* — Westerman, Hattori, Daniels & Adrian, LLP

(57) ABSTRACT

A vertical pump includes: a rotary shaft; multi-stage impellers; a casing accommodating the multi-stage impellers; a mechanical seal provided in a penetration part of the casing for the rotary shaft; a balance sleeve, the balance sleeve being positioned between a final stage impeller of the multi-stage impellers and the mechanical seal in the penetration part for the rotary shaft; an intermediate chamber provided between the rotary shaft and the casing and provided on an opposite side of the multi-stage impellers across the balance sleeve in an axial direction of the rotary shaft, the intermediate chamber communicating with an intermediate stage impeller among the multi-stage impellers; a low
(Continued)

pressure chamber provided between the rotary shaft and the casing, the low pressure chamber communicating with a low pressure side compared to the intermediate chamber; and a partition wall part dividing the intermediate chamber and the low pressure chamber.

22 Claims, 6 Drawing Sheets

(51) Int. Cl.

| | |
|---|---|
| ***F04D 29/041*** | (2006.01) |
| ***F04D 1/08*** | (2006.01) |
| ***F04D 7/02*** | (2006.01) |
| ***F04D 29/42*** | (2006.01) |
| ***F04D 1/06*** | (2006.01) |
| ***F04D 13/00*** | (2006.01) |
| ***F04D 29/08*** | (2006.01) |

(52) U.S. Cl.
CPC ..... *F04D 7/02* (2013.01); *F04D 13/00* (2013.01); *F04D 13/02* (2013.01); *F04D 15/00* (2013.01); *F04D 29/086* (2013.01); *F04D 29/426* (2013.01); *F04D 29/4293* (2013.01)

(58) Field of Classification Search
CPC ..... F04D 29/4293; F04D 7/02; F04D 1/08; F04D 1/066; F04D 1/06; F04D 13/00
USPC ..... 422/187
See application file for complete search history.

(56) References Cited

FOREIGN PATENT DOCUMENTS

| | | | |
|---|---|---|---|
| DE | 681087 | C | 9/1939 |
| GB | 2 092 140 | A | 8/1982 |
| JP | 37-007269 | | 7/1962 |
| JP | 52-103001 | A | 8/1977 |
| JP | 57-128669 | A | 8/1982 |
| JP | 64-040713 | A | 2/1989 |
| JP | 1-095593 | U | 6/1989 |
| JP | 7-054798 | A | 2/1995 |
| JP | 8-277798 | A | 10/1996 |
| JP | 10-030731 | A | 2/1998 |
| JP | 11-223193 | A | 8/1999 |
| JP | 11-324989 | A | 11/1999 |
| JP | 2006-183465 | A | 7/2006 |
| JP | 2011-122506 | A | 6/2011 |
| WO | 2013/143446 | A1 | 10/2013 |
| WO | 2016/152892 | A1 | 9/2016 |

OTHER PUBLICATIONS

International Search Report dated Feb. 6, 2018, issued in counterpart Application No. PCT/JP2017/040481, with English translation (14 pages).
Notification of Transmittal of Copies of Translation of the International Preliminary Report on Patentabililty (Form PCT/IB/338) issued in counterpart International Application No. PCT/JP2017/040481 dated Jul. 25, 2019 with Forms PCT/IB/373 and PCT/ISA/237, with English translation (22 pages).
Extended Search Report dated Jun. 14, 2019, issued in counterpart EP Application No. 17891523.7, with English ranslation (8 pages).
Office Action dated Nov. 29, 2019, issued in counterpart CN Application No. 201780048520.1, with English machine translation. (24 pages).

* cited by examiner

VERTICAL PUMP AND UREA SYNTHESIS PLANT

TECHNICAL FIELD

The present disclosure relates to a vertical pump and a urea synthesis plant.

BACKGROUND ART

Conventionally, a thrust balancing mechanism is used for balancing thrust force generated on a rotary shaft of a pump.

For instance, Patent Document 1 discloses a multistage centrifugal pump having a thrust balancing device including a balance sleeve inserted into a shaft portion of the pump. In this thrust balancing device, while one end face of the balance sleeve is located on the rear side of the final stage impeller, the other end of the balance sleeve is adjacent to a space communicating with a suction side of the pump. Further, a force in an opposite direction to a thrust force, which is a reverse thrust force, is transmitted to the pump shaft corresponding to the pressure difference at both end faces of the balance sleeve, that is, the difference between a discharge pressure and a suction side pressure at the final stage impeller.

CITATION LIST

Patent Literature

Patent Document 1: JPH11-223193A

SUMMARY

Problems to be Solved

Meanwhile, in a pump having a large discharge pressure, when the reverse thrust force is to be obtained by the differential pressure between the suction pressure and the discharge pressure, a fluid leaking from the high pressure side (the discharge pressure side) to the low pressure side (the suction pressure side) in the thrust balancing mechanism may be vaporized by rapid pressure reduction. As described above, when the leaking fluid is vaporized, a sliding part in the thrust balancing mechanism is burned by heat generation, and a large thrust load may be generated without balancing the thrust load.

In view of the above, an object of at least one embodiment of the present invention is to provide a vertical pump and a urea synthesis plant capable of appropriately balancing thrust force while suppressing vaporization of the fluid.

Solution to the Problems (1) A vertical pump according to at least one embodiment of the present invention comprises: a rotary shaft; multi-stage impellers configured to rotate with the rotary shaft; a casing accommodating the multi-stage impellers; a mechanical seal provided in a penetration part of the casing for the rotary shaft;

a balance sleeve for at least partially balancing a thrust force of the rotary shaft, the balance sleeve being positioned between a final stage impeller of the multi-stage impellers and the mechanical seal in the penetration part for the rotary shaft; an intermediate chamber provided between the rotary shaft and the casing and provided on an opposite side of the multi-stage impellers across the balance sleeve in an axial direction of the rotary shaft, the intermediate chamber communicating with an intermediate stage impeller among the multi-stage impellers; a low pressure chamber provided between the rotary shaft and the casing and provided adjacent to the mechanical seal in the axial direction, the low pressure chamber communicating with a low pressure side compared to the intermediate chamber; and a partition wall part dividing the intermediate chamber and the low pressure chamber.

With the above configuration (1), a pressure of the intermediate stage impeller is applied to the balance sleeve, the reverse thrust force caused by a differential pressure between a pressure of liquid passing through the final stage impeller and a pressure of the intermediate stage impeller, which is a discharge pressure, is applied to the balance sleeve, thus it is possible to achieve balancing of the thrust force of the vertical pump. Further, the intermediate chamber is communicated with the intermediate stage impeller to keep a pressure of the intermediate chamber to a relatively high value, thus it is possible to suppress vaporization caused by rapid pressure reduction of liquid (process fluid) leaking through the balance sleeve. Furthermore, the low pressure chamber partitioned with the intermediate chamber by the partition wall part is communicated with a lower pressure side than the intermediate stage impeller, thus it is possible to reduce pressure acting on the mechanical seal connected to the low pressure chamber, enabling to the use of the mechanical seal with simple configuration.

In the present specification, the "intermediate stage impeller" refers to an arbitrary impeller on the downstream side of the first stage impeller and on the upstream side of the final stage impeller.

(2) In some embodiments, in the above configuration (1), the mechanical seal includes: a pair of stationary rings provided in the casing; and a pair of rotary rings configured to be rotatable with the rotary shaft so as to slide with respect to the respective stationary rings. The mechanical seal is a tandem mechanical seal in which the stationary rings and the rotary rings are alternately arranged in the axial direction.

As described in the above (1), the vertical pump according to at least some embodiments is capable of reducing pressure acting on the mechanical seal connected to the low pressure chamber. Thus, the tandem mechanical seal according to the above configuration (2) is capable of sealing liquid (process fluid) in the vertical pump by using an external fluid being in lower pressure than a double mechanical seal.

(3) In some embodiments, in the above configuration (1) or (2), the casing includes: an intermediate casing covering the multi-stage impellers; an outer casing provided so as to cover the intermediate casing; and a casing cover attached to the outer casing so as to seal an upper end opening of the outer casing and having the penetration part for the rotary shaft. The vertical pump further comprises: a lower bearing supporting a low end part of the rotary shaft rotatably to the intermediate casing; and an intermediate bearing supporting an intermediate part of the rotary shaft rotatably to the intermediate casing. The intermediate chamber communicates with the intermediate stage impeller positioned above the lower bearing and below the intermediate bearing.

With the above configuration (3), the rotary shaft is supported by the lower bearing and the intermediate bearing, thus it is possible to reduce vibration of the rotary shaft. That is, while the lower bearing suppresses a mode (first mode) in which a lower portion of the rotary shaft swings, the intermediate bearing suppresses a mode (second mode) in which an intermediate portion of the rotary shaft. Further, as described in the above configuration (3), the intermediate chamber communicates with the intermediate stage impeller between the lower bearing and the intermediate bearing, thus it is possible to effectively suppress vaporization caused by rapid pressure reduction of leakage liquid through the balance sleeve while a sufficiently large reverse thrust force is applied to the balance sleeve.

(4) In some embodiments, in any one of the above configurations (1) to (3), the vertical pump is configured to pressurize liquid liquefied by compressing substance which is gas under normal temperature and atmospheric pressure.

As describe in the above (1), in the vertical pump according to at least some embodiments, the intermediate chamber communicates with the intermediate stage impeller, thus it is possible to suppress vaporization caused by rapid pressure reduction of the leakage liquid through the balance sleeve. Thus, with the above configuration (4), it is possible to suppress vaporization of the leakage liquid through the balance sleeve even when the vertical pump pressurizes liquid liquefied by compressing substance which is gas under normal temperature and atmospheric pressure.

(5) In some embodiments, in any one of the above configurations (1) to (4), the casing includes: an intermediate casing covering the multi-stage impellers; an outer casing provided so as to cover the intermediate casing; and a casing cover attached to the outer casing so as to seal an upper end opening of the outer casing and having the penetration part for the rotary shaft. A balance internal flow passage communicating with the intermediate chamber is formed in the casing cover. The casing further includes a balance pipe provided between the intermediate casing and the outer casing so that the balance internal flow passage and the intermediate stage impeller communicate with each other.

With the above configuration (5), it is possible to communicate the intermediate chamber with the intermediate stage impeller by the simple configuration using the balance internal flow passage provided in the casing cover and the balance pipe. Accordingly, it is possible to obtain technical benefit of the configuration which communicating the intermediate chamber with the intermediate stage impeller, that is, a benefit achieving both balance maintenance of the thrust force of the vertical pump and vaporization suppression of the leakage liquid through the balance sleeve.

(6) In some embodiments, in any one of the above configurations (1) to (5), the casing includes: an intermediate casing covering the multi-stage impellers; an outer casing provided so as to cover the intermediate casing; and a casing cover attached to the outer casing so as to seal an opening of the outer casing. The intermediate casing includes: a plurality of first sections stacked in an axial direction of the vertical pump and provided so as to surround a plurality of impellers of a first group among the multi-stage impellers; a plurality of second sections stacked in the axial direction and provided so as to surround a plurality of impellers of a second group among the multi-stage impellers; and a fastening section provided between the plurality of first sections and the plurality of second sections in the axial direction. The configuration further comprises: at least one first tie bolt fixed to the fastening section at one end of the at least one first tie bolt and extending from the fastening section over a positional range occupied by the plurality of first sections in the axial direction; and at least one second tie bolt fixed to the fastening section at one end of the at least one second tie bolt and extending from the fastening section over a positional range occupied by the plurality of second sections in the axial direction opposite to the first tie bolt.

With the above configuration (6), the plurality of first sections and the plurality of second sections at least constitutes the intermediate casing, the fastening section is disposed between the first sections and the second sections, and then the first tie bolt and the second tie bolt extending the opposite direction to the first tie bolt are fixed to the fastening section. Thus, it is possible to shorten the first tie bolt and the second tie bolt in comparison to the case that a long tie bolt extending over the entire intermediate casing holds all sections. Accordingly, each tie bolt is not only improved in rigidity but also manufacturability and assemblability, and then it is possible to reduce influence of thermal elongation of the tie bolt. This provides a large merit in case where the number of impeller stages of the vertical pump is large.

(7) In some embodiments, in the above configuration (6), the plurality of impellers of the first group is provided downstream of the plurality of impellers of the second group, and the at least one first tie bolt has a larger diameter than the at least one second tie bolt.

With the above configuration (7), the at least one first tie bolt corresponding to the impellers of the first group in which a pressure of liquid is higher has a larger diameter than the at least one second tie bolt, thus it is possible to obtain axial force necessary for fixing each section according to the pressure of liquid. Further, a number of the at least one tie bolt can be arranged around the intermediate casing by using the at least one second tie bolt having a relatively small diameter.

(8) In some embodiments, in the above configuration (6) or (7), a plurality of the first tie bolts and a plurality of the second tie bolts are alternately arranged in a circumferential direction of the intermediate casing.

With the above configuration (8), the plurality of first tie bolts and the plurality of second tie bolts are alternately arranged in the circumferential direction, thus the interference between the first tie bolts and the second tie bolts in the fastening section is avoided, and each section can be properly held by equally arranging each tie bolt in the circumferential direction.

(9) In some embodiments, in any one of the above configurations (6) to (8), the configuration further comprises a bearing for rotatably supporting the rotary shaft, the bearing being provided between the fastening section and the rotary shaft.

With the above configuration (9), the bearing is provided for supporting the rotary shaft by utilizing the fastening section which requires a certain thickness to secure the first tie bolt and the second tie bolt. Thus, it is possible to reduce vibration of the rotary shaft while suppressing increase of the axial length of the rotary shaft.

(10) In some embodiments, in any one of the above configurations (6) to (9), the intermediate casing includes: a suction bell section located on a side opposite to the casing cover across the multi-stage impellers in the axial direction, the suction bell section having a suction bell for introducing liquid to a first stage impeller of the multi-stage impellers. The other end of the at least one first tie bolt is fixed to the casing cover. The other end of the at least one second tie bolt is fixed to the suction bell section.

With the above configuration (10), the first tie bolt extending between the casing cover and the fastening section and the second tie bolt extending between the fastening section and the suction bell section are utilized, thus it is possible to integrally hold the plurality of first sections and the plurality of second sections while suppressing the length of each tie bolt in a case where the number of stages of the vertical pump is large.

(11) In some embodiments, in any one of the above configurations (6) to (10), the configuration comprises: an intermediate chamber provided between the rotary shaft and the casing and provided on an opposite side of the multi-stage impellers across the balance sleeve in an axial direction of the rotary shaft, the intermediate chamber communicating with an intermediate stage impeller among the multi-stage impellers; and a balance pipe directed from the casing cover to one section of the first sections or the second sections and provided between the intermediate casing and the outer casing so that the intermediate chamber and the intermediate stage impeller communicate with each other. The balance pipe is arranged so as to be offset in a radial direction or a circumferential direction of the intermediate casing with respect to at least one of the first tie bolt or the second tie bolt in a plan view.

With the above configuration (11), a pressure of the intermediate stage impeller is applied to the balance sleeve, the reverse thrust force caused by a differential pressure between a pressure of liquid passing through the final stage impeller, which is a discharge pressure, and a pressure of the intermediate stage impeller is applied to the balance sleeve, thus it is possible to achieve balancing of the thrust force of the vertical pump. Further, the intermediate changer is communicated with the intermediate stage impeller to keep a pressure of the intermediate chamber to a relatively high value, thus it is possible to suppress vaporization caused by rapid pressure reduction of liquid leaking through the balance sleeve. Furthermore, it is possible to communicate the intermediate chamber with the intermediate stage impeller by the simple configuration using the balance pipe.

(12) In some embodiments, in the above configuration (11), the intermediate casing includes: a suction bell section located on a side opposite to the casing cover across the multi-stage impellers in the axial direction, the suction bell section having a suction bell for introducing liquid to a first stage impeller of the multi-stage impellers. The other end of the at least one first tie bolt is fixed to the casing cover. The other end of the at least one second tie bolt is fixed to the suction bell section. The balance pipe is arranged so as to be offset in the radial direction with respect to any one of the at least one first tie bolt and connects with any one of the second sections through between a pair of second tie bolts which are adjacent to each other in the circumferential direction.

As the above configuration (12), in addition to the technical benefit described in the above configuration (10), it is also possible to obtain technical benefit capable of avoiding interference between the first tie bolts and the second tie bolts and the balance pipe even in a case where the number of the first tie bolts and the second tie bolts is large.

(13) In some embodiments, in any one of the above configurations (6) to (12), the multi-stage impellers include impellers in ten or more stages.

With the above configuration (13), the vertical pump 4 having the impellers in ten or more stages are used, thus it is possible to ensure a sufficient discharge pressure even if the number of revolutions of the vertical pump is lowered. Thus, it is possible to effectively suppress cavitation in the first stage impeller by reducing the number of revolutions of the vertical pump.

(14) In some embodiments, in any one of the above configurations (1) to (13), the configuration comprises: a suction port; a plurality of multi-stage impellers arranged along a vertical direction and being configured so that liquid taken in through the suction port passes through the plurality of multi-stage impellers; and a discharge port for discharging the liquid passing through the multi-stage impellers. The casing comprises: an intermediate casing covering the multi-stage impellers; an outer casing provided so as to cover the intermediate casing; and a casing cover attached to the outer casing so as to seal an opening of the outer casing. The casing cover is constituted of a plate member having a low-pressure internal flow passage communicating with the suction port and a high-pressure internal flow passage communicating with the discharge port.

With the above configuration (14), the casing cover of the vertical pump is constituted of the plate member in which the low-pressure internal flow passage and the high-pressure internal flow passage is formed, thus it is possible to reduce a height of the casing cover as compared with a case when the casing cover is formed of a casting having a low-pressure flow passage and a high-pressure flow passage. Accordingly, it is possible to achieve the compact vertical pump by reducing the dimension in the height direction of the vertical pump.

Further, the high-pressure internal flow passage is formed in the plate member, thus it is possible to cope with higher pressure as compared with a case where the casing cover is formed of a casting.

(15) In some embodiments, in the above configuration (14), the configuration further comprises: a suction pipe having the suction port and being attached to a peripheral edge of the plate member constituting the casing cover so that the suction port and the low-pressure internal flow passage are communicated with each other; and a discharge pipe having the discharge port and being attached to a peripheral edge of the plate member so that the suction port and the low-pressure internal flow passage are communicated with each other.

With the above configuration (15), the suction pipe and the discharge pipe which are separately from the plate member constituting the casing cover are attached to the peripheral edges of the plate member, which facilitates processing of the casing cover.

(16) In some embodiments, in the above configuration (14) or (15), the low-pressure internal flow passage includes: a first radial flow passage outwardly extending in a radial direction of the plate member toward the suction port; and a first axial flow passage connected to the first radial flow passage and extending along an axial direction of the plate member. The first axial flow passage communicates with a space between the outer casing and the intermediate casing.

With the above configuration (16), the low-pressure internal flow passage is formed by the first radial flow passage and the first axial flow passage, thus it is possible to simplify structure of the low-pressure internal flow passage, which enable easy processing of the low-pressure internal flow passage.

(17) In some embodiments, in any one of the above configurations (14) to (16), the high-pressure internal flow passage includes: an annular flow passage communicating with an outlet of the final stage impeller closest to the casing cover among the multi-stage impellers; and a second radial flow passage outwardly extending in a radial direction of the plate member from the annular flow passage toward the discharge port.

With the above configuration (17), the high-pressure internal flow passage is formed by the annular flow passage and the second radial flow passage, thus it is possible to simplify structure of the high-pressure internal flow passage, which enable easy processing of the high-pressure internal flow passage.

(18) In some embodiments, in the above configuration (17), the annular flow passage includes a scroll flow passage having a flow passage cross-sectional area that varies along a circumferential direction of the plate member.

With the above configuration (18), the annular flow passage is formed by the scroll flow passage, thus it is possible to reduce pressure loss of a flow of high pressure liquid from the final stage impeller in the annular flow passage.

(19) In some embodiments, in any one of the above configurations (14) to (18), the intermediate casing comprises: a plurality of sections stacked in an axial direction of the vertical pump and provided so as to surround the multi-stage impellers; and a fastening section located on an opposite side of the casing cover across the plurality of sections in the axial direction. The configuration further comprises a plurality of tie bolts each having one end fixed to the plate member constituting the casing cover and the other end fixed to the fastening section. In addition to the low-pressure internal flow passage and the high-pressure internal flow passage, the plate member has a plurality of bolt holes into which the one end of the plurality of tie bolts are screwed, respectively.

With the above configuration (19), the plate member constituting the casing cover and the fastening section are fastened by the tie bolts, thus it is possible to integrally hold the plurality of sections interposed between the plate member and the fastening section and to simplify casing structure of the vertical pump.

(20) In some embodiments, in any one of the above configurations (14) to (19), the configuration further comprises a thrust balancing part provided at the penetration part of the plate member for the rotary shaft, the plate member constituting the casing cover. The thrust balancing part includes: the balance sleeve configured to rotate with the rotary shaft, the balance sleeve being attached to an outer periphery of the rotary shaft; and a balance bushing provided on the plate member on an outer peripheral side of the balance sleeve. The intermediate chamber is formed between the plate member and the rotary shaft on an opposite side of the multi-stage impellers across the thrust balancing part in the axial direction of the vertical pump. A balance internal flow passage is formed in the plate member so as to communicate the intermediate chamber with the intermediate stage impeller of the multi-stage impellers.

With the above configuration (20), a pressure of the intermediate stage impeller is applied to the balance sleeve of the thrust balancing part, the reverse thrust force caused by a differential pressure between a pressure of liquid passing through the final stage impeller, which is a discharge pressure, and a pressure of the intermediate stage impeller is applied to the balance sleeve, thus it is possible to achieve balancing of the thrust force of the vertical pump. Further, the intermediate stage impeller communicates with the intermediate chamber through the balance internal flow passage, thus it is possible to suppress vaporization caused by rapid pressure reduction of liquid leaked out of the thrust balancing part.

(21) In some embodiments, in any one of the above configurations (1) to (20), the discharge pressure of the vertical pump is 10 MPa or more.

Generally, a horizontal pump rotating at a high speed, for example, of 6000 rpm or more is used to obtain a high discharge pressure of 10 MPa or more. However, when using the horizontal pump with a high rotation speed, cavitation in the first stage impeller of the horizontal pump may be a problem. It is possible to provide a booster pump, for example, between a tank and the horizontal pump to suppress the cavitation. In this case, it may be a problem that equipment installation space enlarges accompanying installation of the booster pump and facility cost increases.

With the above configuration (21), a pump rotation speed is lowered by using the multi-stage vertical pump described in the above configuration (1) and increasing the number of stages of the impellers of the vertical pump even in a case where a discharge pressure of 10 MPa or more is required. It is possible to suppress the cavitation at the first stage impeller.

Further, when the discharge pressure is a high pressure of 10 MPa or more, vaporization caused by of leak liquid through the balance sleeve caused by rapid pressure reduction of liquid leaking through the balance sleeve and complication of the structure of the mechanical seal can be a problem. In this regard, as described the above configuration (1), the intermediate chamber is communicated with the intermediate stage impeller to keep a pressure of the intermediate chamber to a relatively high value, thus it is possible to suppress vaporization caused by rapid pressure reduction of leaked liquid (process fluid) through the balance sleeve. Further, the low pressure chamber partitioned with the intermediate chamber by the partition wall part is communicated with a lower pressure side than the intermediate stage impeller, thus it is possible to reduce pressure acting on the mechanical seal connected to the low pressure chamber, enabling to the use of the mechanical seal with simple configuration.

Further, if the number of stages of the impellers of the vertical pump increases, there is a demerit that the tie bolt becomes longer to integrally hold the sections of the intermediate casing. However, in a case of adopting the above configuration (6), when using the first tie bolt and the second tie bolt which extend in opposite directions from the fastening section, it is possible to shorten each tie bolt even in a case where the number of stages of the vertical pump is large.

(22) In some embodiments, in any one of the above configurations (1) to (21), The vertical pump is an ammonia pump for pressurizing a raw material ammonia in the urea synthesis plant or a carbamate pump for pressurizing a carbamate that is intermediate in the urea synthesis plant.

The ammonia pump and the carbamate pump in the urea synthesis plant raise the ammonia or the carbamate to a high pressure of, for example, 10 MPa or more and is used to supply the urea to a reactor for generating urea.

In this regard, with the above configuration (22), a pump rotation speed is lowered by using the multi-stage vertical pump described in the above configuration (1) as the ammonia pump or the carbamate pump in the urea synthesis plant and increasing the number of stages of the impellers of the vertical pump. It is possible to suppress the cavitation at the first stage impeller.

Further, the intermediate changer is communicated with the intermediate stage impeller to keep a pressure of the intermediate chamber to a relatively high value by using the multi-stage vertical pump described in the above configuration (1) as the ammonia pump or the carbamate pump in the urea synthesis plant, thus it is possible to suppress vaporization caused by rapid pressure reduction of liquid leaking through the balance sleeve. Further, the low pressure chamber partitioned with the intermediate chamber by the partition wall part is communicated with a lower pressure side than the intermediate stage impeller, thus it is possible to reduce pressure acting on the mechanical seal connected to the low pressure chamber, enabling to the use of the mechanical seal with simple configuration.

Further, if the number of stages of the impellers of the vertical pump increases, there is a demerit that the tie bolt becomes longer to integrally hold the sections of the intermediate casing. However, in a case of adopting the above configuration (6), when using the first tie bolt and the second tie bolt which extend in opposite directions from the fastening section, it is possible to shorten each tie bolt even in a case where the number of stages of the vertical pump is large.

Further, in a case of using the above configuration (14), the casing cover of the vertical pump as the ammonia pump or the carbamate pump in the urea synthesis plant is constituted of the plate member having the low-pressure internal flow passage and the high-pressure internal flow passage, thus it is possible to reduce a height of the casing cover as compared with a case when the casing cover is formed of a casting having a low-pressure flow passage and a high-pressure flow passage. Accordingly, it is possible to archive the compact vertical pump by reducing the dimension in the height direction of the vertical pump. Further, the high-pressure internal flow passage is formed in the plate member, thus it is possible to cope with higher pressure as compared with a case where the casing cover is formed of a casting.

(23) A urea synthesis plant according to at least one embodiment of the present invention comprises: an ammonia pump for pressurizing a raw material ammonia; a carbamate pump for pressurizing a carbamate that is intermediate; and a reactor to which the ammonia pressurized by the ammonia pump, the carbamate pressurized by the carbamate pump, and carbon dioxide are supplied. At least one of the ammonia pump or the carbamate pump is the vertical pump according to any one of the above (1) to (22).

With the above configuration (23), a pump rotation speed is lowered by using the multi-stage vertical pump described in the above configuration (1) as the ammonia pump or the carbamate pump in the urea synthesis plant and increasing the number of stages of the impellers of the vertical pump. It is possible to suppress the cavitation at the first stage impeller.

Further, the intermediate changer is communicated with the intermediate stage impeller to keep a pressure of the intermediate chamber to a relatively high value by using the multi-stage vertical pump described in the above configuration (1) as the ammonia pump or the carbamate pump in the urea synthesis plant, thus it is possible to suppress vaporization caused by rapid pressure reduction of liquid leaking through the balance sleeve. Further, the low pressure chamber partitioned with the intermediate chamber by the partition wall part is communicated with a lower pressure side than the intermediate stage impeller, thus it is possible to reduce pressure acting on the mechanical seal connected to the low pressure chamber, enabling to the use of the mechanical seal with simple configuration.

Further, if the number of stages of the impellers of the vertical pump increases, there is a demerit that the tie bolt becomes longer to integrally hold the sections of the intermediate casing. However, in a case of adopting the above configuration (6), when using the first tie bolt and the second tie bolt which extend in opposite directions from the fastening section, it is possible to shorten each tie bolt even in a case where the number of stages of the vertical pump is large.

Further, in a case of using the above configuration (14), the casing cover of the vertical pump as the ammonia pump or the carbamate pump in the urea synthesis plant is constituted of the plate member having the low-pressure internal flow passage and the high-pressure internal flow passage, thus it is possible to reduce a height of the casing cover as compared with a case when the casing cover is formed a casting having a low-pressure flow passage and a high-pressure flow passage. Accordingly, it is possible to archive the compact vertical pump by reducing the dimension in the height direction of the vertical pump. Further, the high-pressure internal flow passage is formed in the plate member, thus it is possible to cope with higher pressure as compared with a case where the casing cover is formed of a casting.

(24) A casing cover of the vertical pump according to at least one embodiment of the present invention which is the casing cover of the vertical pump according to any one of the above (1) to (22), the casing cover comprises: a plate member having a low-pressure internal flow passage communicating with the suction port of the vertical pump and a high-pressure internal flow passage communicating with the discharge port of the vertical pump.

With the above configuration (24), the casing cover of the vertical pump is constituted of the plate member having the low-pressure internal flow passage and the high-pressure internal flow passage, thus it is possible to reduce a height of the casing cover as compared with a case when the casing cover is formed of a casting having a low-pressure flow passage and a high-pressure flow passage. Accordingly, it is possible to archive the compact vertical pump by reducing the dimension in the height direction of the vertical pump.

Further, the high-pressure internal flow passage is formed in the plate member, thus it is possible to cope with higher pressure as compared with a case where the casing cover is formed of a casting.

(25) A method of manufacturing a casing cover of the vertical pump according to at least one embodiment of the present invention which is the method of manufacturing the casing cover of the vertical pump according to any one of the above (1) to (22), the method comprises: a step forming, by machining, a plate member having a low-pressure internal flow passage communicating with a suction port of the vertical pump and a high-pressure internal flow passage communicating with a discharge port of the vertical pump, and manufacturing the casing cover.

With the above manufacturing method (25), the low-pressure internal flow passage communicating with the suction port of the vertical pump and the high-pressure internal flow passage communicating with the discharge port of the vertical pump is formed in the plate member by machining, thus it is possible to reduce a height of the casing cover as compared with a case when the casing cover is formed of a casting having a low-pressure flow passage and a high-pressure flow passage. Accordingly, it is possible to archive the compact vertical pump by reducing the dimension in the height direction of the vertical pump.

Further, the high-pressure internal flow passage is formed in the plate member, thus it is possible to cope with higher pressure as compared with a case where the casing cover is formed of a casting.

Advantageous Effects

According to at least one embodiment of the present invention, a vertical pump and a urea synthesis plant capable of appropriately balancing thrust force with suppressing vaporization of the fluid is provided.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
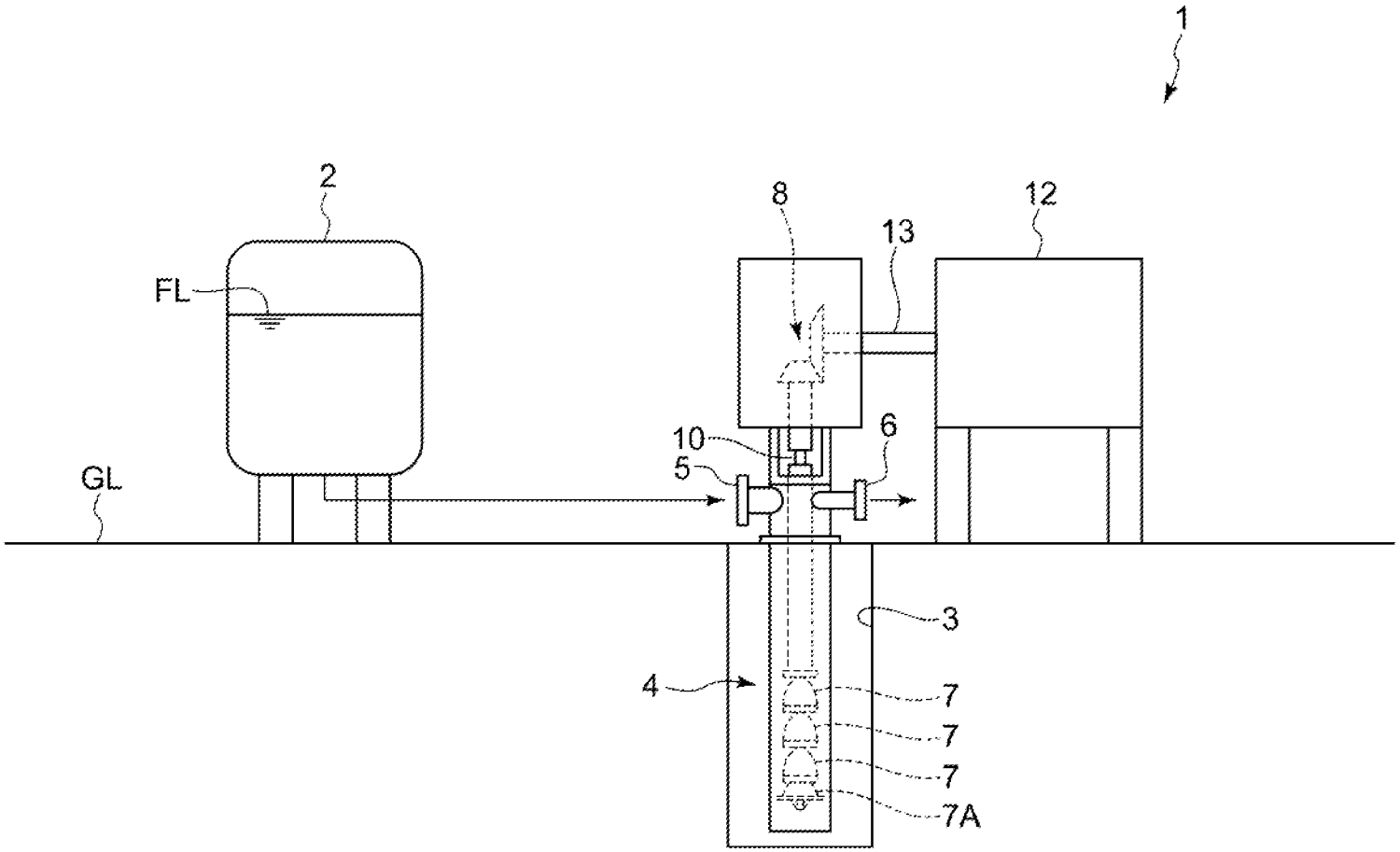
FIG. 1 is a schematic configuration diagram of an example of a liquid booster apparatus to which a vertical pump according to an embodiment is applied.

FIG. 1 is a schematic configuration diagram of an example of a liquid booster apparatus to which a vertical pump according to some embodiments is applied. As shown in FIG. 1, a liquid booster apparatus 1 includes a tank 2 for storing liquid to be pressurized, which is a process fluid, a vertical pump 4 for pressurizing the liquid supplied from the tank 2, a motor 12 for driving the vertical pump 4.

The tank 2 is installed on a device installation surface GL and a fluid level FL in the tank 2 is positioned above the device installation surface GL.

As shown in FIG. 1, at least a part of the vertical pump 4 is housed in a recessed part 3 formed by digging down from the device installation surface GL. In an illustrative embodiment depicted in FIG. 1, a lower part of the vertical pump 4 is housed in the recessed part 3.

The vertical pump 4 includes a suction port 5 connected to the tank 2, multi-stage impellers 7 arranged in a vertical direction, a discharge port 6 for discharging the liquid passing through the multi-stage impellers 7. An impeller 7 positioned at the lowest position among the multi-stage impellers 7 is a first stage impeller 7*a*. The first stage impeller 7*a* positions below the device installation surface GL to which the tank 2 is installed.

Further, the vertical pump 4 has a rotary shaft 10 extending along the vertical direction. The rotary shaft 10 is connected to an output shaft 13 of the motor 12, thus the multi-stage impellers 7 is configured to rotate with the rotary shaft 10 by being driven by the motor 12.

In an illustrative embodiment depicted in FIG. 1, the output shaft 13 of the motor 12 for driving the vertical pump 4 extends along a horizontal direction, and a bevel gear 8 is provided over the vertical pump 4 for transmitting power between the output shaft 13 of the motor 12 and the rotary shaft 10 of the vertical pump 4. Further, the motor 12 is positioned on the side of vertical pump 4 without overlapping with the vertical pump 4 in a plan view.

Although not depicted, in some other embodiments, the output shaft 13 of the motor 12 for driving the vertical pump 4 may extend along the vertical direction and directly connect to the rotary shaft 10 of the vertical pump 4.

The vertical pump 4 is configured such that the liquid from the tank 2 is supplied through the suction port 5. The liquid supplied from the suction port 5 flows into the first stage impeller 7A, passes through the first stage impeller 7A and flows sequentially to downstream side impellers 7. The liquid is pressurized by receiving rotational energy of the impellers 7 when passing through the multi-stage impellers 7. The high-pressure liquid passing through the final stage impeller 7 provided on the most downstream side of the multi-stage impellers 7 is discharged from the vertical pump 4 through the discharge port 6.

In the liquid booster apparatus 1, the use of the multi-stage vertical pump 4 described above can reduce the installation space of the apparatus as compared with the use of a horizontal type multi-stage pump in which the plurality of stages of the impellers are arranged in the horizontal direction. Further while securing high discharge pressure by increasing the number of stages of the impellers 7, it is possible to reduce the number of revolutions of the pump. Thus, it is possible to suppress cavitation in the first stage impeller 7A by reducing the number of revolutions of the pump. Further, the vertical pump 4 is arranged so that the first stage impeller 7A is positioned below the device installation surface GL, thus it is possible to suppress cavitation in the first stage impeller 7A while reducing the height of the installation position of the tank 2 and sufficiently secure a head difference between the tank 2 and the vertical pump 4.

Thus, since cavitation in the first stage impeller 7A can be suppressed by using the vertical pump 4, it is not necessary to provide a booster pump between the tank 2 and the pump (vertical pump 4) or it is not necessary to set the tank 2 at high installation position. Accordingly, it is possible to archive reduction in facility cost and space saving in the liquid booster apparatus 1.

Figure 2:
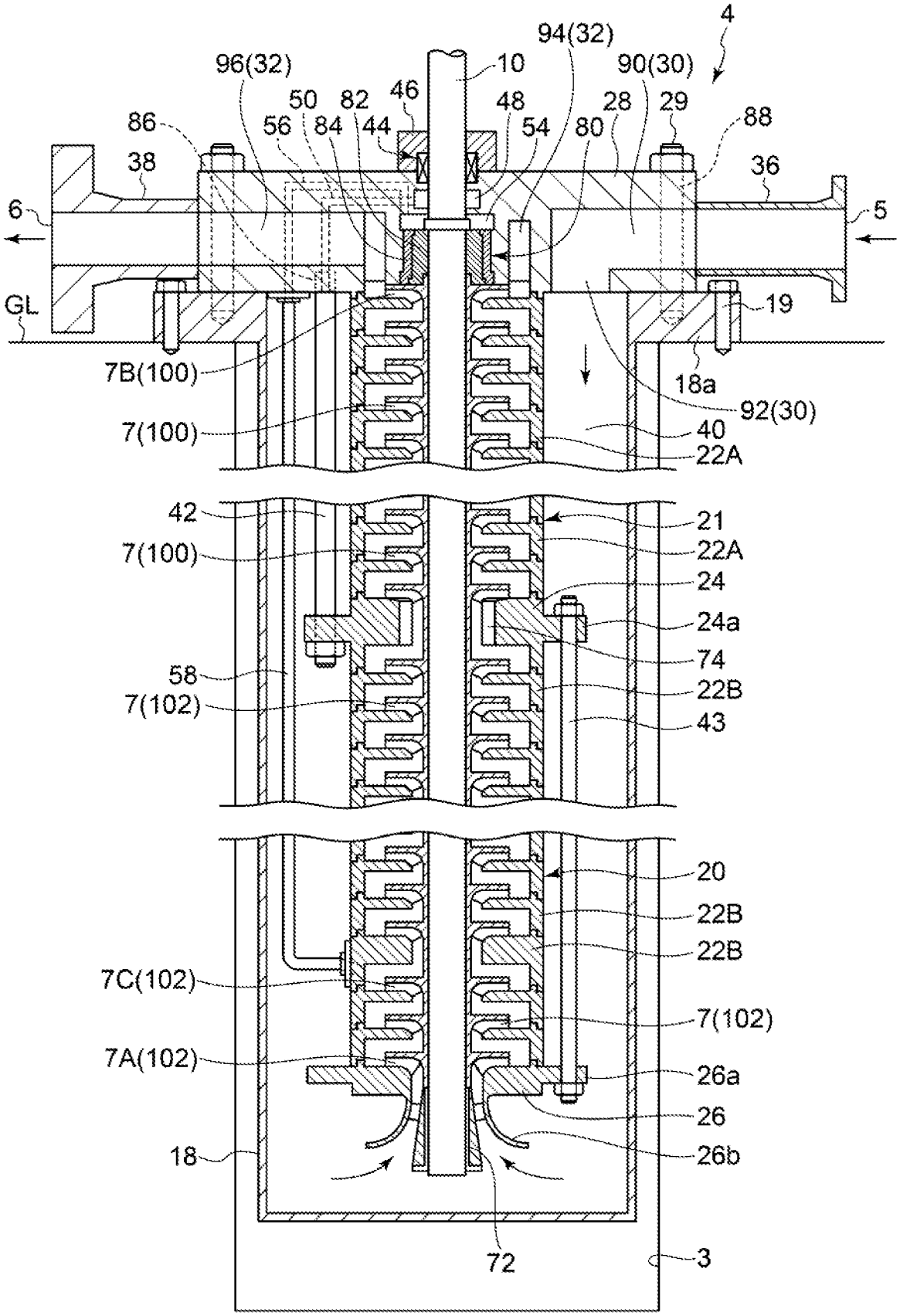
FIG. 2 is a schematic cross-sectional view of the vertical pump according to an embodiment.

FIG. 2 is a schematic cross-sectional view of the vertical pump 4 according to an embodiment. An arrow in FIG. 2 represents a direction of a flow of the liquid (process fluid) in the vertical pump 4.

As shown in FIG. 2, the vertical pump 4 includes the multi-stage impellers 7 described above, and a casing including an outer casing 18, an intermediate casing 20 and a casing cover 28. The multi-stage impellers 7 is accommodated in the casing. The intermediate casing 20 is provided inside the outer casing 18 so as to cover the multi-stage impellers 7. The casing cover 28 is attached to the outer casing 18 so as to seal an upper end opening of the outer casing 18. Further, the rotary shaft 10 rotating with the multi-stage impellers 7 is rotatably supported by the intermediate casing 20 by way of a lower bearing 72 and an intermediate bushing 74 installed and extending a wear ring part of the impeller relative to a normal impeller.

Further, the vertical pump 4 depicted in FIG. 2 includes a thrust balancing part 80 provided at a penetrating part of the casing cover 28 for the rotary shaft 10 and a mechanical seal 44 as shaft sealing device.

The outer casing 18 includes a flange part 18*a* provided on an upper end part so as to protrude outward in a radial direction of the rotary shaft 10 (hereinafter, referred to as simply "radial direction"), and is fixed to the device installation surface GL by a plurality of bolts 19 passing through bolt holes provided in the flange part 18*a*. A portion of the outer casing 18 below the flange part 18*a* is housed in a recessed part 3 formed by digging down from the device installation surface GL.

The casing cover 28 is fixed to the outer casing 18 by bolts 29 arranged in a circumferential direction of the rotary shaft 10. A low-pressure internal flow passage 30 communicating with the suction port 5 and a high-pressure internal flow passage 32 communicating with the discharge port 6 are formed in the casing cover 28.

A flow passage 40 for liquid flowing from a low-pressure internal flow passage 30 formed in the suction port 5 and the casing cover 28 toward the first stage impeller 7A positioned at the lowest part of the multi-stage impellers 7, is formed between the outer casing 18 and the intermediate casing 20.

The liquid flowing toward the first stage impeller 7A through the flow passage 40 is led to a suction bell 26*b* (described below) located at the lowest part of the intermediate casing 20 flows into the first stage impeller 7A.

Further, after flowing into the first stage impeller 7A, the liquid passing through the multi-stage impeller 7 and flowing out from an outlet port of the final stage impeller 7B is discharged from the discharge port 6 to an outside of the vertical pump 4 through the high-pressure internal flow passage 32. The final stage impeller 7B is the impeller closest to the casing cover 28 among the multi-stage impellers 7.

Figure 3A:
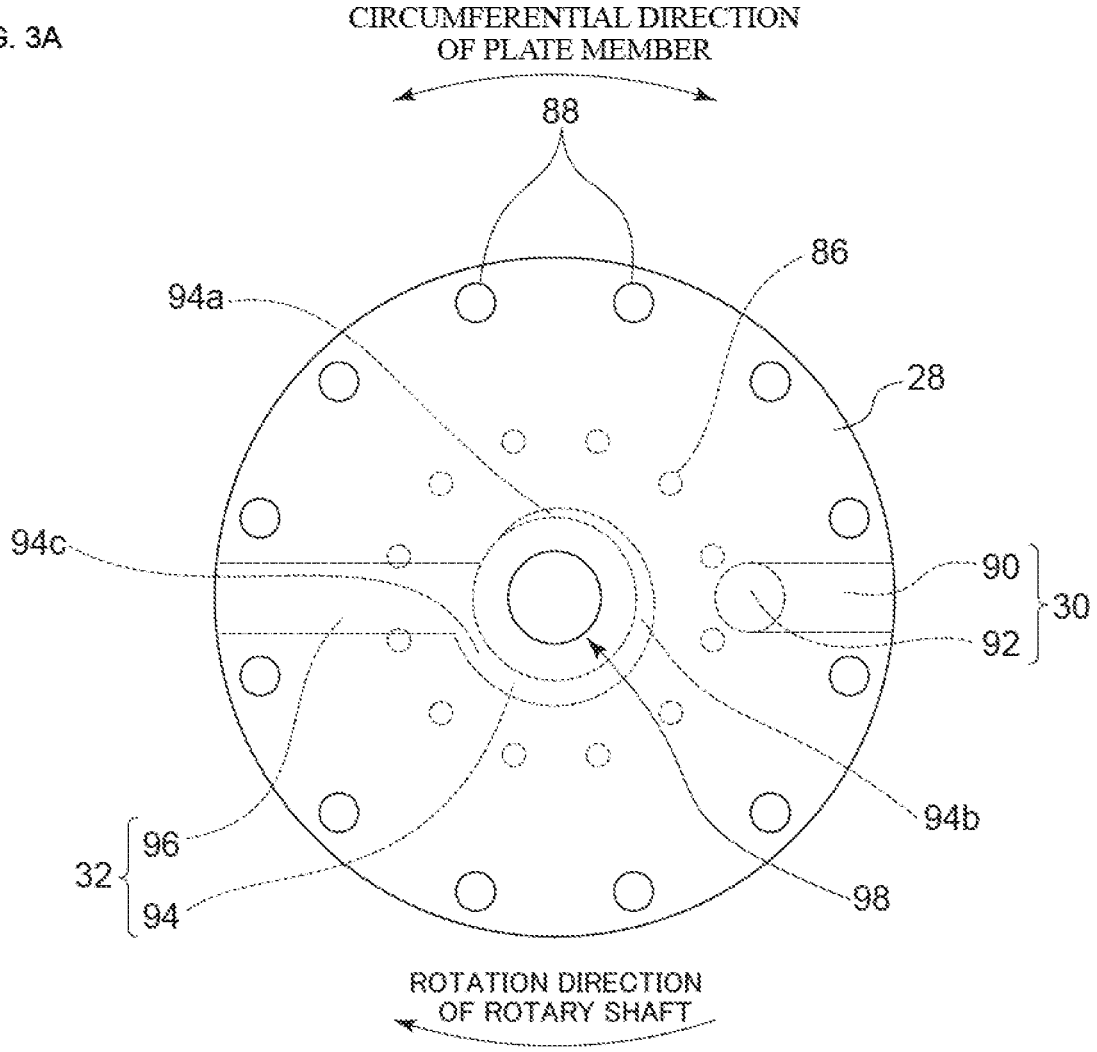
FIG. 3A is a planar view of a casing cover of the vertical pump depicted in FIG. 2.
Figure 3B:
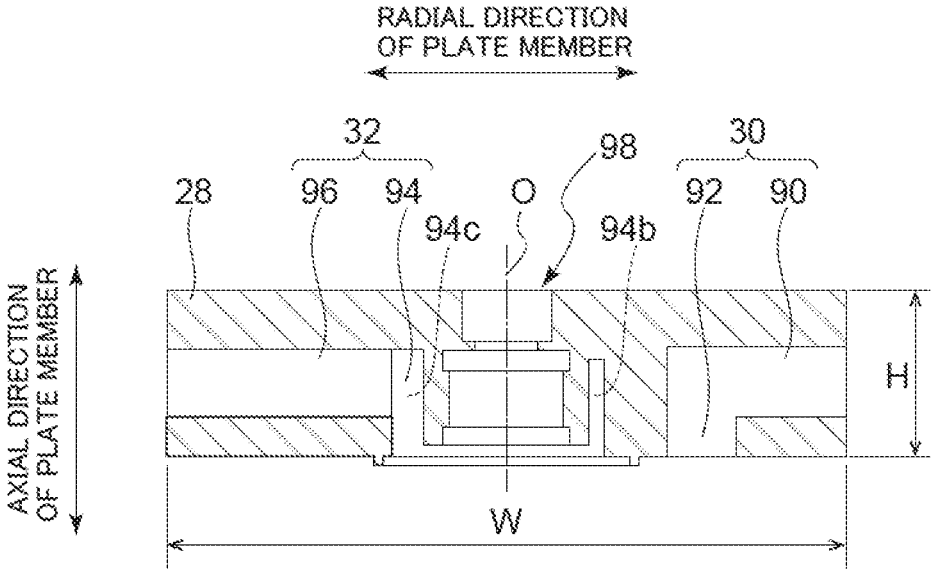
FIG. 3B is a cross-section view along an axial direction of the casing cover of the vertical pump depicted in FIG. 2.

FIG. 3A is a planar view of the casing cover 28 of the vertical pump 4 depicted in FIG. 2 and FIG. 3B is a cross-section view of the casing cover 28 of the vertical pump 4 depicted in FIG. 2 along an axial direction of the rotary shaft 10, which is a direction along a rotation axis O of the rotary shaft 10; hereinafter, as referred as simply "axial direction". In FIGS. 3A and 3B, some of flow passages and bolt holes are not shown, for the sake of convenience for description.

As shown in FIGS. 3A and 3B, a penetrating part 98 through which the rotary shaft 10 of the vertical pump 4 (see FIG. 2) passes along the axial direction is provided at the center part of the casing cover 28.

In some embodiments, as shown in FIGS. 2 to 3B, the casing cover 28 is constituted of a plate member having the low-pressure internal flow passage 30 and the high-pressure internal flow passage 32. The low-pressure internal flow passage 30 and the high-pressure internal flow passage 32 may be formed inside the plate member by machining.

Thus, the casing cover 28 of the vertical pump 4 is constituted of the plate member in which the low-pressure internal flow passage 30 and the high-pressure internal flow passage 32 are formed, then it is possible to reduce the height of the casing cover 28 as compared with a case where the casing cover 28 includes a low-pressure flow passage and a high-pressure flow passage and is formed by casting. Accordingly, it is possible to archive the compact vertical pump 4 by reducing the dimension in the height direction of the vertical pump 4. Further, the high-pressure internal flow passage 32 is formed in the plate member, thus it is possible to cope with higher pressure as compared with a case where the casing cover 28 is formed of a casting.

As shown in FIG. 3B, when H is the height (dimension in the axial direction) of the casing cover 28 constituting of the plate member, W is the dimension of the casing cover 28 in the radial direction (direction orthogonal to the rotation axis O) of the rotary shaft 10 (see FIG. 2), the aspect ratio W/H of the casing cover 28 is not smaller than 10/4 and not greater than 10/1.

As shown in FIG. 2, a suction nozzle 36 (suction pipe) having the suction port 5 and a discharge nozzle 38 (discharge pipe) having the discharge port 6 may be attached in the vertical pump 4. The suction nozzle 36 is provided so as to communicating the suction port 5 and the low-pressure internal flow passage 30 provided inside the casing cover 28. The discharge nozzle 38 is provided so as to communicating the discharge port 6 and the high-pressure internal flow passage 32 provided inside the casing cover 28.

Thus, the suction nozzle 36 and the discharge nozzle 38 which are separately from the plate member constituting the casing cover 28 are attached to the peripheral edges of the plate member so as to constitute the vertical pump 4, which facilitates processing of the casing cover 28.

The suction nozzle 36 and the discharge nozzle 38 may be a member having a flange connection part as shown in FIG. 2. Further, the suction nozzle 36 and the discharge nozzle 38 are attached to the plate member constituting of the casing cover 28 by welding.

In some embodiments, as shown in FIGS. 2 to 3B, the low-pressure internal flow passage 30 formed inside the casing cover 28 includes a first radial flow passage 90 radially extending to the outside in the radial direction (see FIG. 3B) of the plate member, and a first axial flow passage 92 connecting with the first radial flow passage 90 and extending along the axial direction (see FIG. 3B) of the plate member.

Thus, the low-pressure internal flow passage 30 is formed by the first radial flow passage 90 and the first axial flow passage 92, thus it is possible to simplify structure of the low-pressure internal flow passage 30, which enable easy processing of the low-pressure internal flow passage 30.

Further, in some embodiments, as shown in FIGS. 2 to 3B, the high-pressure internal flow passage 32 formed inside the casing cover 28 includes an annular flow passage 94 communicating with an outlet of the final stage impeller 7B (see FIG. 2) and a second radial flow passage 96 outwardly extending in a radial direction of the plate member from the annular flow passage 94 toward the discharge port 6 (see FIG. 2).

Thus, the high-pressure internal flow passage 32 is formed by the annular flow passage 94 and the second radial flow passage 96, thus it is possible to simplify structure of the high-pressure internal flow passage 32, which enable easy processing of the high-pressure internal flow passage 32.

The casing cover 28 has a plurality of bolt holes 88 into which the plurality of bolts 29 screwed so as to fix the casing cover 28 to the outer casing 18. As shown in FIG. 3A, the plurality of bolt holes 88 are arranged so as to be offset in the circumferential direction of the plate member constituting of the casing cover 28 with respect to the first radial flow passage 90 and the second radial flow passage 96.

In some embodiments, as shown in FIGS. 2 to 3B, the annular flow passage 94 formed in the casing cover 28 is a scroll flow passage having a flow passage cross-sectional area that varies along a circumferential direction (see FIG. 3A) of the plate member. The flow passage cross-section area of the scroll flow passage may increase from an upstream side to a downstream side in the rotation direction of the rotary shaft 10 of the vertical pump 4.

For example, as shown in FIGS. 3A and 3B, the flow passage cross-section area of the annular flow passage 94 (scroll flow passage) becomes larger in the order of the upstream part 94*a*, the midstream part 94*b* and the downstream part 94*c* of the annular flow passage 94 (see FIGS.

3A and 3B) from the upstream side to the downstream side in the rotation direction of rotary shaft 10 of the vertical pump 4.

In this way, the annular flow passage 94 is formed by the scroll flow passage, thus it is possible to reduce pressure loss of a flow of high pressure liquid from the final stage impeller 7B in the annular flow passage 94.

In some embodiments, as shown in FIG. 2, the intermediate casing 20 includes a plurality of sections (22A, 22B, 24 and 26) are stacked in the axial direction of the rotary shaft 10 and a plurality of tie bolts (a plurality of first tie bolts 42 and a plurality of second tie bolts 43) for fastening the plurality of sections (22A, 22B, 24 and 26).

In an illustrative embodiment shown in FIG. 2, the plurality of sections constituting the intermediate casing 20 are stacked in the axial direction and includes a plurality of first sections 22A and a plurality of second sections 22B provided so as to surround the multi-stage impellers 7, a fastening section 24 provided between the plurality of first sections 22A and the plurality of second sections 22B and being fixed with one ends of the plurality of tie bolts (42, 43) and a suction bell section 26 positioned at the lowest part of the plurality of sections.

The suction bell section 26 is located on a side opposite to the casing cover 28 across the multi-stage impellers 7 in the axial direction and has the suction bell 26*b* for introducing liquid to the first stage impeller 7A of the multi-stage impellers 7.

The plurality of first sections 22A are provided so as to surround a plurality of impellers 7 of a first group 100 located downstream among the multi-stage impellers 7.

The plurality of second sections 22B are provided so as to surround a plurality of impellers 7 of a second group 102 located upstream relative to the plurality of impellers 7 of the first group 100 among the multi-stage impellers 7.

The fastening section 24 is located on an opposite side of the casing cover 28 across the plurality of first sections 22A in the axial direction.

The plurality of first tie bolts 42 extends from the fastening section 24 over a positional range occupied by the plurality of first sections 22A in the axial direction. Each one end of the plurality of first tie bolts 42 is fixed to the fastening section 24 while each other end of the plurality of first tie bolts 42 is fixed to the casing cover 28.

In some embodiments, as shown in FIG. 2, the fastening section 24 includes a flange part 24*a* provided so as to protrude outward in the radial direction and each one end of the plurality of first tie bolts 41 is screwed into a bolt hole formed in the flange part 24*a* of the fastening section 24. Further, in some embodiments, as shown in FIG. 2, each other end of the plurality of tie bolts 42 is screwed into a corresponding one of plurality of bolt holes 86 formed in the plate member constituting the casing cover 28.

As shown in FIG. 3A, the plurality of bolt holes 86 formed in the casing cover 28 are arranged so as to be offset in the radial direction or the circumferential direction of the plate member constituting of the casing cover 28 with respect to the first axial flow passage 92.

The plurality of second tie bolts 43 extends from the fastening section 24 over a positional range occupied by the plurality of second sections 22B in the axial direction opposite to the first tie bolts 42. Each one end of the plurality of second tie bolts 43 is fixed to the fastening section 24 while each other end of the plurality of second tie bolts 43 is fixed to the suction bell section 26.

In some embodiments, as shown in FIG. 2, each one end of the plurality of second tie bolts 43 is screwed into the bolt hole formed in the flange part 24*a* of the fastening section 24 described above. Further, in some embodiments, as shown in FIG. 2, the suction bell section 26 includes the flange part 26*a* provided so as to protrude outward in the radial direction and each other end of the plurality of second tie bolts 43 is screwed into the bolt hole formed in the flange part 26*a* of the suction bell section 26.

In some embodiments, the plurality of sections constituting the intermediate casing 20 are divided into three or more groups (first sections, second sections, third sections and the like), each having a different position in the axial direction. The sections of the 3 or more groups may be fastened by three or more tie bolts each extending a different positional range in the axial direction.

In this way, in some embodiments, the intermediate casing 20 is constituted by at least the plurality of first sections 22A, the plurality of second sections 22B and the fastening section 24 is disposed between the first sections 22A and the second sections 22B, the fastening section 24 is fixed with the first tie bolts 42 and the second tie bolts 43 extending in the direction opposite to the first tie bolts 42. Thus, it is possible to shorten the first tie bolts 42 and the second tie bolts 43 in comparison to the case that a long tie bolt extending over the entire intermediate casing 20 holds all sections. Accordingly, each tie bolt (42, 43) is not only improved in rigidity but also manufacturability and assemblability, and then it is possible to reduce influence of thermal elongation of each tie bolt (42, 43). This provides a large merit in case where the number of impeller stages of the vertical pump 4 is large.

the plate member constituting the casing cover 28 and the fastening section 24 are fastened by the tie bolts (42, 43), thus it is possible to integrally hold the plurality of sections (first sections 22A) interposed between the plate member and the fastening section 24, or the plurality of sections (second sections 22B) interposed between the fastening section 24 and the suction bell section 26 and to simplify casing structure of the vertical pump 4.

Further, the first tie bolts 42 extending between the casing cover 28 and the fastening section 24 and the second tie bolts 43 extending between the fastening section 24 and the suction bell section 26 are utilized, thus it is possible to integrally hold the plurality of first sections 22A and the plurality of second sections 22B while suppressing the length of each tie bolt (42, 43) even in a case where the number of stages of the vertical pump 4 is large.

In some embodiments, the first tie bolts 42 for holding the plurality of first sections 22A positioned downstream have a larger diameter than the second tie bolts 43 for holding the plurality of second sections 22B positioned upstream of the plurality of first sections 22A.

Thus, the first tie bolts 42 corresponding to the impellers 7 of the first group 100 in which the pressure of liquid is higher have a larger diameter than the second tie bolts 43, thus it is possible to obtain axial force necessary for fixing each section according to the pressure of liquid. Further, a number of tie bolts (42, 43) can be arranged around the intermediate casing 20 by using the second tie bolts 43 each having a relatively small diameter.

Figure 4:
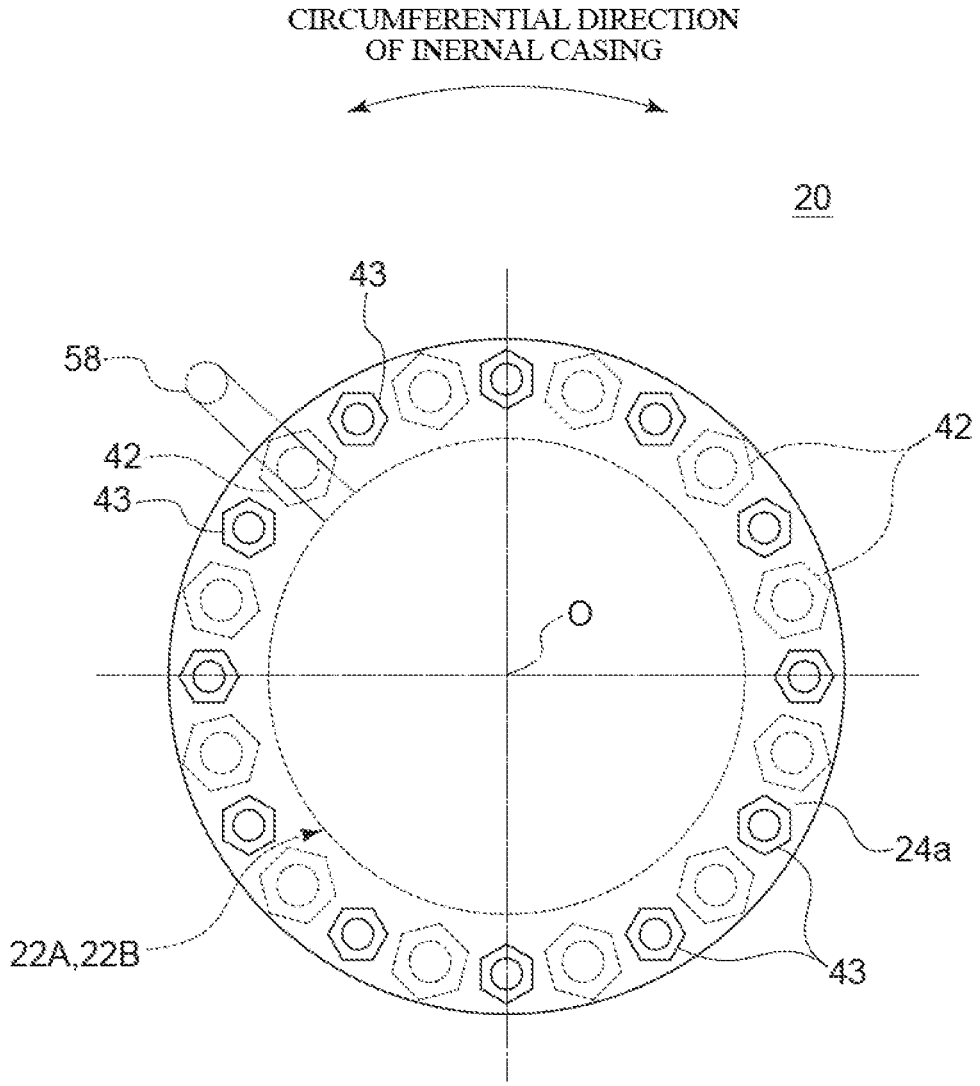
FIG. 4 is a planar view of a flange part of a fastening section according to an embodiment.

FIG. 4 is a diagram showing a configuration of the plurality of tie bolts (42, 43) in the intermediate casing 20 and a planar view of the flange part 24*a* of the fastening section 24.

As shown in FIG. 4, in some embodiments, the first tie bolts 42 and the second tie bolts 43 are alternately arranged in the circumferential direction of the intermediate casing 20.

In this way, the plurality of first tie bolts 42 and the plurality of second tie bolts 43 are alternately arranged in the circumferential direction, thus the an interference between the first tie bolts 42 and the second tie bolts 43 in the fastening section 24 is avoided, and each section (22A, 22B, 24, 26) can be properly held by equally arranging each tie bolt (42, 43) in the circumferential direction.

In some embodiments, as described above, the rotary shaft 10 is rotatably supported by the lower bearing 72 and the intermediate bushing 74 installed and extending the wear ring part of the impeller relative to a normal impeller. As shown in FIG. 2, the lower bearing 72 rotatably supports a lower end part of the rotary shaft 10 to the intermediate casing 20. Further, the intermediate bushing 74 functions as an intermediate bearing rotatably supporting an intermediate part of the rotary shaft 10 to the intermediate casing. The intermediate bushing 74 is provided in an axial position between the first stage impeller 7A and the final stage impeller 7B. Further, the lower bearing 72 is provided on the opposite side of the casing cover 28 across the intermediate bushing 74 in the axial direction.

In this way, the rotary shaft 10 is supported by the lower bearing 72 and the intermediate bearing 74, thus it is possible to reduce vibration of the rotary shaft 10. That is, while the lower bearing 72 suppresses a mode (first mode) in which a lower portion of the rotary shaft 10 swings, the intermediate bearing 74 suppresses a mode (second mode) in which an intermediate portion of the rotary shaft 10.

The lower bearing 72 or the intermediate bushing 74 may be provided between the fastening section 24 and the rotary shaft 10. In an illustrative embodiment shown in FIG. 2, the intermediate bushing 74 is provided between the fastening section 24 and the rotary shaft 10.

The fastening section 24 requires a certain degree of thickness to fix the first tie bolts 42 and the second tie bolts 43. For instance, as shown in FIG. 2, if the flange part 24*a* for fixing the one end of the tie bolt to the fastening section 24, the thickness of the fastening section 24 is set to be large to a certain degree so as to secure the thickness of the flange part 24*a*. In this regard, the fastening section 24 having a certain length is utilized, the bearing for supporting the rotary shaft 10 (intermediate bushing 74 in example of shown in FIG. 2) is provided, thus it is possible to reduce vibration of the rotary shaft 10 while suppressing increase of the axial length of the rotary shaft 10.

In some embodiments, each lower end part of the sections (22A, 22B, 24) and an upper end part of an adjacent section (22A, 22B, 24, 26) to the corresponding one of the sections may have a socket-and-spigot structure 21.

In an illustrative embodiment shown in FIG. 2, the socket-and-spigot structure is formed by a convex part provided so as to project downward at an outer peripheral side edge part of each lower end part of the sections (22A, 22B, 24) and a recess part provided on the upper end part of the adjacent section to the corresponding one of the sections so as to correspond to the convex part described above.

Figure 5:
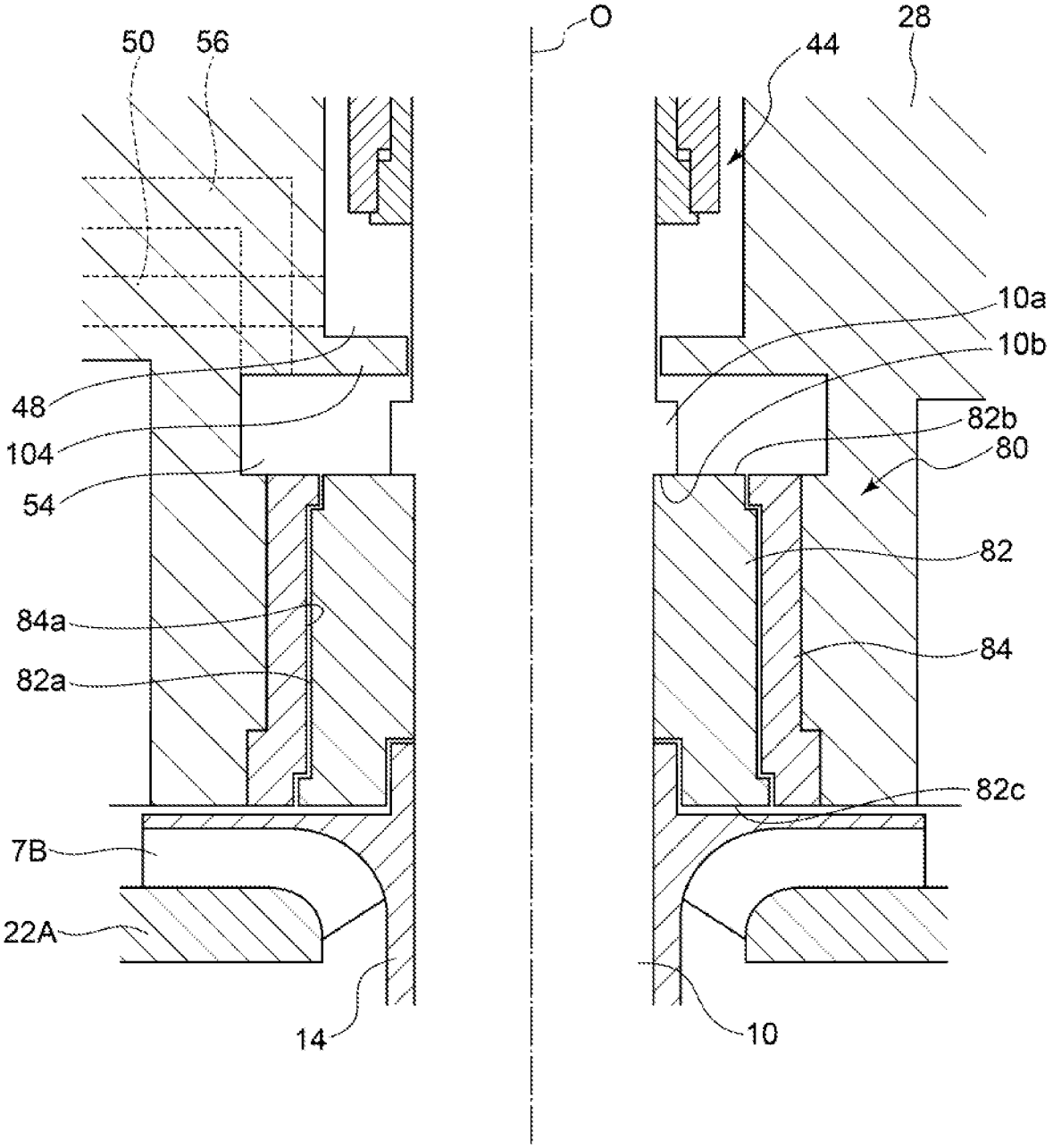
FIG. 5 is a schematic cross-sectional view of a configuration of a thrust balancing part of the vertical pump depicted in FIG. 2.

Thus, each positioning of the sections (22A, 22B, 24, 26) in the radial direction is facilitated by forming the socket-and-spigot structure between the plurality of adjacent sections, FIG. 5 is a schematic cross-sectional view of a configuration of the thrust balancing part 80 of the vertical pump 4 depicted in FIG. 2.

In some embodiments, as shown in FIGS. 2 and 5, the thrust balancing part 80 includes a balance sleeve 82 attached to the outer periphery of the rotary shaft 10 and being configured to rotate with the rotary shaft 10 and a balance bushing 84 provided on the casing cover 28 on the outer peripheral side of the balance sleeve 82. As described below, the balance sleeve 82, for example, is configured to at least partially balance the thrust force of the rotary shaft 10.

The thrust force acting on the rotary shaft 10 is a force in a direction from a high pressure side to a low pressure side of the multi-stage impellers 7 (see FIG. 2) in the axial direction, that is, a force in a direction from the final stage impeller 7B to the first stage impeller 7A.

As shown in FIG. 5, the balance sleeve 82 is provided on the back side of the final stage impeller 7B of the multi-stage impellers 7 in the penetrating part 98 (see FIGS. 3A and 3B) of the casing cover 28 for the rotary shaft 10. The balance sleeve 82 may be attached to the rotary shaft by, for example, a shrink fitting.

An outer peripheral surface 82*a* of the balance sleeve 82 rotating with the rotary shaft 10 slides with respect to an inner peripheral surface 84*a* of the balance bushing 84 when the rotary shaft 10 rotates.

An intermediate chamber 54 is formed on the opposite side of the multi-stage impellers 7 across the balance sleeve 82 (thrust balancing part 80) in the axial direction between the rotary shaft 10 and the plate member constituting the casing cover 28. An upper end surface 82*b* of the balance sleeve 82 is adjacent to the intermediate chamber 54 such that the pressure of the intermediate chamber 54 acts on the upper end surface 82*b*.

As shown in FIG. 5, the rotary shaft 10 has an expanded diameter part 10*a* provided in a positional range where the intermediate chamber 54 exists and the expanded diameter part 10*a* may include a lower end surface 10*b* facing the upper end surface 82*b* of the balance sleeve 82. Further, force between the balance sleeve 82 and the rotary shaft 10 in the axial direction may be transmitted through the lower end surface 10*b* of the expanded diameter part 10*a* and the upper end surface 82*b* of the balance sleeve 82.

As shown in FIG. 2, the intermediate chamber 54 communicates with an intermediate stage impeller 7C of the multi-stage impellers 7 through a balance internal flow passage 56 formed in the plate member constituting the casing cover 28 and the balance pipe 58 communicating with the balance internal flow passage 56. The balance pipe 58 is provided to expand from the casing cover 28 toward any one section (any one of the second sections 22B in the embodiment depicted in FIG. 2) of the first sections 22A or the second sections 22B between the intermediate casing 20 and the outer casing 18 so as to communicate the balance internal flow passage 56 and the intermediate stage impeller 7*c*.

Herein, the intermediate stage impeller 7C refers to an arbitrary impeller 7 on the downstream side of the first stage impeller 7A and on the upstream side of the final stage impeller 7B. In an illustrative embodiment shown in FIG. 2, the intermediate stage impeller 7C includes an impeller 7, among the multi-stage impellers 7, positioned above the lower bearing 72 and below the intermediate bushing 74. Alternatively, in the embodiment depicted in FIG. 2, the intermediate stage impeller 7C includes an impeller 7, among the multi-stage impellers 7, belonging to the second group 102 located on the upstream side (impeller 7 surrounded by the plurality of second sections 22B).

That is, a pressure $P_M$ of the intermediate stage impeller 7C is introduced into the intermediate chamber 54 communicating with the intermediate stage impeller 7C and the pressure $P_M$ of the intermediate stage impeller 7C acts on the upper end surface 82*b* (see FIG. 5) of the balance sleeve 82.

Further, the lower end surface 82*c* (see FIG. 5) of the balance sleeve 82 is adjacent to a space on the back surface side of the final stage impeller 7B and a pressure (discharge pressure $P_D$) of liquid passing through the final stage impeller 7B acts on the lower end surface 82*c*.

Thus, as described above, the pressure $P_M$ of the intermediate stage impeller 7C acts on the balance sleeve 82 and it is possible to act the reverse thrust force (force opposite to thrust force described above in axial direction), which is caused by a differential pressure between the pressure (discharge pressure $P_D$ (>$P_M$)) of liquid passing through the final stage impeller 7B and the pressure $P_M$ of the intermediate stage impeller 7C, on the rotary shaft 10 through the balance sleeve 82. Accordingly, it is possible to archive balancing of the thrust force of the vertical pump 4.

Moreover, even if the differential pressure between the pressure of the intermediate chamber 54 and the discharge pressure $P_D$ acting on the lower end surface 82C of the balance sleeve 82 is excessively large, a fluid leaking through between the balance sleeve 82 and the balance bushing 84 may be rapidly decompressed and may be vaporized.

In this regard, as described the above, the intermediate chamber 54 is communicated with the intermediate stage impeller 7C to keep the pressure of the intermediate chamber 54 to a relatively high value (for example, at least pressure higher than pressure of liquid flowing into first stage impeller 7A), thus it is possible to suppress vaporization caused by rapid pressure reduction of liquid (process fluid) leaking through the balance sleeve 82.

The balance pipe 58 is arranged so as to be offset in the radial direction or the circumferential direction of the intermediate casing 20 with respect to at least one of the first tie bolts 42 or the second tie bolts 43 in a plan view.

In some embodiments, as shown in FIGS. 2 and 4 for instance, the balance pipe 58 is arranged so as to be offset in the radial direction with respect to any of the first tie bolts 42 and connects with any one of the second sections 22B through between a pair of second tie bolts 43 which are adjacent to each other in the circumferential direction.

In this way, the balance pipe 58 is arranged offset in the radial direction or the circumferential direction with respect to at least one of the first tie bolts 42 or the second tie bolts 43. It is possible to avoid interference between the balance pipe 58 and the first tie bolts 42 and the second tie bolts 43 even in a case where the number of the first tie bolts 42 and the second tie bolts 43 is large.

In some embodiments, the vertical pump 4 may be configured to pressurize liquid liquefied by compressing substance which is gas under normal temperature and atmospheric pressure.

In the vertical pump 4 in which the above-described thrust balancing part 80 is provided, the intermediate chamber 54 communicates with the intermediate stage impeller 7C, thus it is possible to suppress vaporization caused by rapid pressure reduction of liquid (process fluid) leaking through the balance sleeve 82. Thus, as described above, it is possible to suppress vaporization of the liquid leaking through the balance sleeve 82 even when the vertical pump 4 pressurizes liquid liquefied by compressing substance which is gas under normal temperature and atmospheric pressure.

Figure 6:
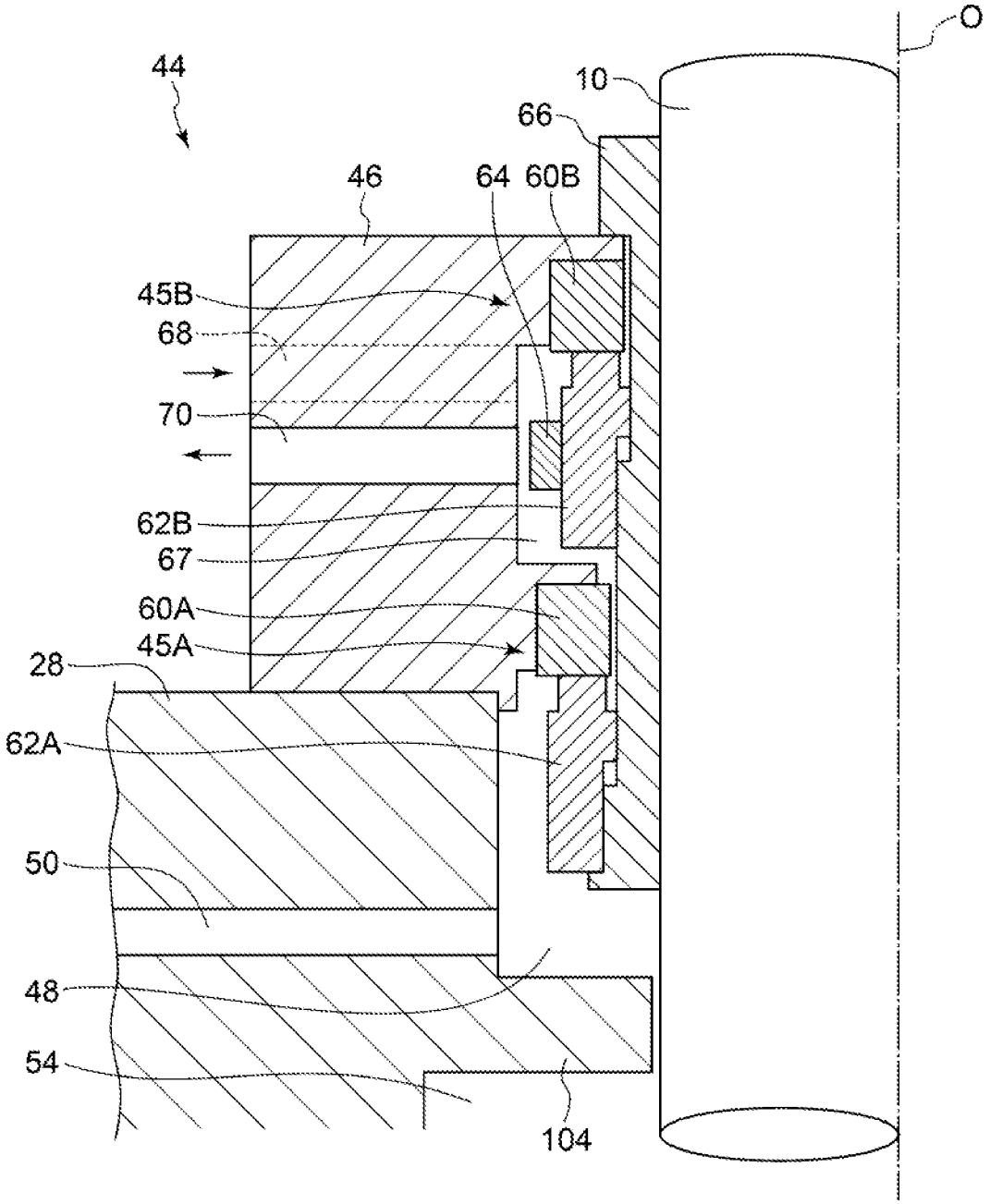
FIG. 6 is a schematic cross-sectional view of a configuration of a mechanical seal of the vertical pump depicted in FIG. 2.

FIG. 6 is a schematic cross-sectional view of the configuration of the mechanical seal 44 of the vertical pump 4 depicted in FIG. 2.

In some embodiments, as shown in FIGS. 2 and 6, the casing of the vertical pump 4 includes a seal housing part 46 fixed to the casing cover 28 and the seal housing part 46 at least partially accommodates the mechanical seal 44. Further, the penetrating part is provided such that the rotary shaft 10 penetrates the casing cover 28 and the seal housing part 46.

The mechanical seal 44 depicted in FIG. 6 includes a pair of stationary rings 60A, 60B attached to the seal housing part 46 (casing) and a pair of rotary rings 62A, 62B configured to be rotatable with the rotary shaft 10 and is a tandem mechanical seal in which the stationary rings and the rotary rings are alternately arranged in the axial direction. That is, in the embodiment shown in FIG. 6, the stationary rings and the rotary rings are arranged in the order of a rotary ring 62A, a stationary ring 60A, a rotary ring 62B and a stationary ring 60B from the side closer to the multi-stage impellers 7 in the axial direction.

The rotary rings 62A, 62B are attached to the outer periphery of the rotary shaft 10 and are fixed to an outer peripheral surface of a shaft sleeve 66 configured to rotate with the rotary shaft 10.

The stationary ring 60A and the rotary ring 62A which are arranged on a side closer to the multi-stage impellers 7 in the axial direction among the pair of stationary rings 60A, 60B and the pair of rotary rings 62A, 62B constitute a high-pressure seal 45A while the stationary ring 60B and the rotary ring 62B which are arranged on a side farther from the multi-stage impellers 7 in the axial direction constitute a low-pressure seal 45B.

The pair of rotary rings 62A, 62B are configured to slide with respect to the pair of stationary rings 60A, 60B with rotation of the rotary shaft 10, respectively. The fluid leakage is suppressed by contacting sliding surfaces of the pair of stationary rings 60A, 60B and the pair of rotary rings 62A, 62B each other.

A low pressure chamber 48 is provided adjacent to the mechanical seal 44 in the axial direction between the rotary shaft 10 and the casing cover 28 (casing). The low pressure chamber 48 communicates with a lower pressure side than the intermediate stage impeller 7C by way of a flushing inlet flow passage 50 formed in the casing cover 28. That is, the fluid in relatively low pressure in the lower pressure side than the intermediate stage impeller 7C is introduced to the low pressure chamber 48.

In an illustrative embodiment depicted in FIGS. 2 and 6, the low pressure chamber 48 communicates with the flow passage 40 formed between the outer casing 18 and the intermediate casing 20. That is, liquid in low pressure, which flows into the vertical pump 4 from the suction port 5, before being pressurized by the multi-stage impellers 7 is introduced to the low pressure chamber 48 through the flushing inlet flow passage 50.

In this way, it is possible to reduce the pressure acting on the mechanical seal 44 connected to the low pressure chamber 48 by introducing the liquid in relatively low pressure to the low pressure chamber 48. Accordingly, the tandem mechanical seal described above is adopted, which is capable of sealing liquid (process fluid) in the vertical pump 4 by using the external fluid being in lower pressure than the double mechanical seal.

In between the rotary shaft 10 and a seal housing part 46 (casing), a seal chamber 67 to which the outside fluid (external fluid) is supplied is provided between the pair of stationary rings 60A, 60B in the axial direction. Further, a buffer inlet flow passage 68 and a buffer outlet flow passage 70 are provided in the seal housing part 46. The buffer inlet flow passage 68 and the buffer outlet flow passage 70 are connected to an external fluid tank (not shown) provided outside the vertical pump 4. The outside fluid stored in the external fluid tank is introduced into the seal chamber 67 through the buffer inlet flow passage 68, is discharged from the seal chamber 67 via the buffer outlet flow passage 70, and is returned to the external fluid tank.

A pumping ring 64 is provided on the rotary ring 62B, among the pair of rotary rings 62A, 62B, which positioned between the pair of stationary rings 60A, 60B, that is, one rotary ring provided in the seal chamber 67. The pumping ring 64 is configured so that the outside fluid is sent from the seal chamber 67 to the external fluid tank through the buffer outlet flow passage 70.

In this way, the external fluid is circulated by the pumping ring 64 then it is not needed an auxiliary machine for circulating the external fluid. Accordingly, it is possible to simplify the auxiliary machine for pressurizing and circulating the external fluid supplied to the shaft seal device as compared with a case where a double mechanical seal is adopted.

In some embodiments, as shown in FIGS. 2, 5 and 6, the balance sleeve 82 of the thrust balancing part 80 is located between the final stage impeller 7B and the mechanical seal 44 in the axial direction. A partition wall part 104 (see FIGS. 5 and 6) dividing the intermediate chamber 54 and the low pressure chamber 48 is provided between the intermediate chamber 54 and the low pressure chamber 48 in the axial direction.

The partition wall part 104 restricts movement of fluid from the intermediate chamber 54 to the low pressure chamber 48 through a gap between the partition wall part 104 and the rotary shaft 10. Thus, it is possible to maintain pressure difference between the intermediate chamber 54 and the low pressure chamber 48.

The partition wall part 104 may be formed by machining the plate member constituting the casing cover 28. Alternatively, the partition wall part 104 is composed of a member different from the plate member constituting the casing cover 28 and is fixed to the casing cover 28.

In this way, the low pressure chamber 48 partitioned with the intermediate chamber 54 by the partition wall part 104 is communicated with the lower pressure side than the intermediate stage impeller 7C, thus it is possible to reduce pressure acting on the mechanical seal 44 connected to the low pressure chamber 48, enabling to the use of the mechanical seal 44 with simple configuration.

In some embodiments, the discharge pressure of the vertical pump 4 is 10 MPa or more.

The vertical pump 4 described above is capable of obtaining a high discharge pressure of, for example, 10 MPa or more and of reducing the number of revolutions of the pump by increasing the number of stages of the impellers 7. It is possible to suppress the cavitation at the first stage impeller 7A.

On the other hand, if the number of stages of the impellers 7 of the vertical pump 4 increases, there is a demerit that the tie bolts (42, 43) become longer to integrally hold the sections of the intermediate casing 20. However, in a case of adopting the vertical pump 4 according to some embodiments, when using the first tie bolts 42 and the second tie bolts 43 which extend in opposite directions from the fastening section 24, it is possible to shorten each tie bolts (42, 43) even in a case where the number of stages of the vertical pump 4 is large.

Further, when the discharge pressure is a high pressure of 10 MPa or more, vaporization caused by of leak liquid through the balance sleeve caused by rapid pressure reduction of liquid leaking through the balance sleeve and complication of the structure of the mechanical seal can be a problem. In this regard, in the vertical pump 4 according to some embodiments, the intermediate chamber 54 is communicated with the intermediate stage impeller 7C to keep the pressure of the intermediate chamber 54 to a relatively high value, thus it is possible to suppress vaporization caused by rapid pressure reduction of leaked liquid (process fluid) through the balance sleeve 82. Further, the low pressure chamber 48 partitioned with the intermediate chamber 54 by the partition wall part 104 is communicated with the lower pressure side than the intermediate stage impeller 7C, thus it is possible to reduce pressure acting on the mechanical seal 44 connected to the low pressure chamber 48, enabling to the use of the mechanical seal 44 with simple configuration.

In some embodiments, the multi-stage impellers 7 include the impellers 7 in ten or more stages.

The vertical pump 4 includes the impellers in ten or more stages, thus it is possible to ensure a sufficient discharge pressure even if the number of revolutions of the vertical pump 4 is lowered. Thus, it is possible to effectively suppress cavitation in the first stage impeller 7A by reducing the number of revolutions of the vertical pump 4.

The vertical pump 4 describe above can be used, for example, as a process pump in a urea synthesis plant (not shown).

The urea synthesis plant according to some embodiments includes an ammonia pump for pressurizing a raw material ammonia, a carbamate pump for pressurizing a carbamate and a reactor to which the ammonia pressurized by the ammonia pump, the carbamate pressurized by the carbamate pump, and carbon dioxide are supplied. At least one of the ammonia pump or the carbamate pump is the vertical pump 4 described above.

For instance, if the ammonia pump is the vertical pump 4, the liquid to be pressurized is liquid ammonia of a raw material of urea and the liquid ammonia is supplied to the vertical pump 4 through the suction port 5.

For instance, if the carbamate pump is the vertical pump 4, the liquid to be pressurized is an intermediate carbamate (carbamate ammonium) generated by reaction of the ammonia and the carbon dioxide and the liquid carbamate is supplied to the vertical pump 4 through the suction port 5.

In the urea synthesis plant described above, the carbamate is generated from ammonia and carbon dioxide under high temperature and high pressure in the reactor to which pressurized ammonia, carbamate and carbon dioxide are supplied. Accordingly, the generated carbamate and a part of the carbamate supplied from the carbamate pump are decomposed into urea and water by a dehydration reaction. Then, the remaining carbamate is sent, for example, to a decomposition tower, heated and decomposed into urea and water by a dehydration reaction. The urea generated by the reactions is separated and recovered as a product. The unreacted remaining carbamate is also separated, recovered, pressurized by the carbamate pump, supplied to the reactor and used in the production of urea.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

DESCRIPTION OF REFERENCE NUMERALS

1 Liquid booster apparatus
2 Tank
3 Recessed part
4 Vertical pump
5 Suction port
6 Discharge port
7 Impeller
7A First stage impeller
7B Final stage impeller
7C Intermediate stage impeller
8 Bevel gear
10 Rotary shaft
10*a* Expanded diameter part
10*b* Lower end surface
12 Motor
13 Output shaft
Outer casing
18*a* Flange part
19 Bolt
20 Intermediate casing
21 Socket-and-spigot structure
22A First section
22B Second section
24 Fastening section
24*a* Flange part
26 Suction bell section
26*a* Flange part
26*b* Suction bell
28 Casing cover
29 Bolt
30 Low-pressure internal flow passage
32 High-pressure internal flow passage
36 Suction nozzle
36 Discharge nozzle
38 Flow passage
40 First tie bolt
41 Second tie bolt
44 Mechanical seal
45A High-pressure seal
45B Low-pressure seal
46 Seal housing part
48 Low pressure chamber
50 Flushing inlet flow passage
54 Intermediate chamber
56 Balance internal flow passage
58 Balance pipe
60A,60B Stationary ring
62A,62B Rotary ring
64 Pumping ring
66 Shaft sleeve
67 Seal chamber
68 Buffer inlet flow passage
70 Buffer outlet flow passage
72 Lower bearing
74 Intermediate bushing
80 Thrust balancing part
82 Balance sleeve
82*a* Outer peripheral surface
82*b* Upper end surface
82*c* Lower end surface
84 Balance bushing
84*a* Inner peripheral surface
86 Bolt hole
88 Bolt hole
90 First radial flow passage
92 First axial flow passage
94 Annular flow passage
96 Second radial flow passage
98 Penetrating part
100 First group
102 Second group
104 Partition wall part
FL Fluid level
GL Device installation surface
O Rotation axis

The invention claimed is:

1. A vertical pump, comprising:
a rotary shaft;
multi-stage impellers configured to rotate with the rotary shaft;
a casing accommodating the multi-stage impellers;
a mechanical seal provided in a penetration part of the casing for the rotary shaft;
a balance sleeve for at least partially balancing a thrust force of the rotary shaft, the balance sleeve being positioned between a final stage impeller of the multi-stage impellers and the mechanical seal in the penetration part for the rotary shaft;
an intermediate chamber provided between the rotary shaft and the casing and provided on an opposite side of the multi-stage impellers across the balance sleeve in an axial direction of the rotary shaft, the intermediate chamber communicating with an intermediate stage impeller among the multi-stage impellers;
a low pressure chamber provided between the rotary shaft and the casing and provided adjacent to the mechanical seal in the axial direction, the low pressure chamber communicating with a low pressure side compared to the intermediate chamber; and
a partition wall part dividing the intermediate chamber and the low pressure chamber.

2. The vertical pump according to claim 1,
wherein the mechanical seal includes:
a pair of stationary rings provided in the casing; and
a pair of rotary rings configured to be rotatable with the rotary shaft so as to slide with respect to the respective stationary rings, and
wherein the mechanical seal is a tandem mechanical seal in which the stationary rings and the rotary rings are alternately arranged in the axial direction.

3. The vertical pump according to claim 1,
wherein the casing includes:
an intermediate casing covering the multi-stage impellers;
an outer casing provided so as to cover the intermediate casing; and a casing cover attached to the outer casing so as to seal an upper end opening of the outer casing and having the penetration part for the rotary shaft, wherein the vertical pump further comprises:

a lower bearing supporting a low end part of the rotary shaft rotatably to the intermediate casing; and an intermediate bearing supporting an intermediate part of the rotary shaft rotatably to the intermediate casing, and wherein the intermediate chamber communicates with the intermediate stage impeller positioned above the lower bearing and below the intermediate bearing.

4. The vertical pump according to claim 1, wherein the vertical pump is configured to pressurize liquid liquefied by compressing substance which is gas under normal temperature and atmospheric pressure.

5. The vertical pump according to claim 1, wherein the casing includes:

an intermediate casing covering the multi-stage impellers;

an outer casing provided so as to cover the intermediate casing; and a casing cover attached to the outer casing so as to seal an upper end opening of the outer casing and having the penetration part for the rotary shaft, wherein a balance internal flow passage communicating with the intermediate chamber is formed in the casing cover, and wherein the casing further includes a balance pipe provided between the intermediate casing and the outer casing so that the balance internal flow passage and the intermediate stage impeller communicate with each other.

6. The vertical pump according to claim 1, wherein the casing includes:

an intermediate casing covering the multi-stage impellers;

an outer casing provided so as to cover the intermediate casing; and a casing cover attached to the outer casing so as to seal an opening of the outer casing, wherein the intermediate casing includes:

a plurality of first sections stacked in an axial direction of the vertical pump and provided so as to surround a plurality of impellers of a first group among the multi-stage impellers;

a plurality of second sections stacked in the axial direction and provided so as to surround a plurality of impellers of a second group among the multi-stage impellers; and a fastening section provided between the plurality of first sections and the plurality of second sections in the axial direction, and wherein the vertical pump further comprises:

at least one first tie bolt fixed to the fastening section at one end of the at least one first tie bolt and extending from the fastening section over a positional range occupied by the plurality of first sections in the axial direction; and at least one second tie bolt fixed to the fastening section at one end of the at least one second tie bolt and extending from the fastening section over a positional range occupied by the plurality of second sections in the axial direction opposite to the first tie bolt.

7. The vertical pump according to claim 6, wherein the plurality of impellers of the first group is provided downstream of the plurality of impellers of the second group, and wherein the at least one first tie bolt has a larger diameter than the at least one second tie bolt.

8. The vertical pump according to claim 6, wherein a plurality of the first tie bolts and a plurality of the second tie bolts are alternately arranged in a circumferential direction of the intermediate casing.

9. The vertical pump according to claim 6, further comprising a bearing for rotatably supporting the rotary shaft, the bearing being provided between the fastening section and the rotary shaft.

10. The vertical pump according to claim 6, wherein the intermediate casing includes:

a suction bell section located on a side opposite to the casing cover across the multi-stage impellers in the axial direction, the suction bell section having a suction bell for introducing liquid to a first stage impeller of the multi-stage impellers, wherein the other end of the at least one first tie bolt is fixed to the casing cover, and wherein the other end of the at least one second tie bolt is fixed to the suction bell section.

11. The vertical pump according to claim 6, wherein the intermediate chamber is provided between the rotary shaft and the casing and provided on an opposite side of the multi-stage impellers across the balance sleeve in an axial direction of the rotary shaft, wherein the vertical pump further comprises a balance pipe directed from the casing cover to one section of the first sections or the second sections and provided between the intermediate casing and the outer casing so that the balance internal flow passage and the intermediate stage impeller communicate with each other, and wherein the balance pipe is arranged so as to be offset in a radial direction or a circumferential direction of the intermediate casing with respect to at least one of the first tie bolt or the second tie bolt in a plan view.

12. The vertical pump according to claim 11, wherein the intermediate casing includes a suction bell section located on a side opposite to the casing cover across the multi-stage impellers in the axial direction, the suction bell section having a suction bell for introducing liquid to a first stage impeller of the multi-stage impellers, wherein the other end of the at least one first tie bolt is fixed to the casing cover, wherein the other end of the at least one second tie bolt is fixed to the suction bell section, and wherein the balance pipe is arranged so as to be offset in the radial direction with respect to any one of the at least one first tie bolt and connects with any one of the second sections through between a pair of second tie bolts which are adjacent to each other in the circumferential direction.

13. The vertical pump according to claim 6, wherein the multi-stage impellers include impellers in ten or more stages.

14. The vertical pump according to claim 1, further comprising:

a suction port;

a plurality of multi-stage impellers arranged along a vertical direction and being configured so that liquid taken in through the suction port passes through the plurality of multi-stage impellers; and a discharge port for discharging the liquid passing through the multi-stage impellers, wherein the casing comprises:

an intermediate casing covering the multi-stage impellers;

an outer casing provided so as to cover the intermediate casing; and a casing cover attached to the outer casing so as to seal an opening of the outer casing, and wherein the casing cover is constituted of a plate member having a low-pressure internal flow passage communicating with the suction port and a high-pressure internal flow passage communicating with the discharge port.

15. The vertical pump according to claim 14, further comprising:

a suction pipe having the suction port and being attached to a peripheral edge of the plate member constituting the casing cover so that the suction port and the low-pressure internal flow passage are communicated with each other; and a discharge pipe having the discharge port and being attached to a peripheral edge of the plate member so that the suction port and the low-pressure internal flow passage are communicated with each other.

16. The vertical pump according to claim 14, wherein the low-pressure internal flow passage includes:

a first radial flow passage outwardly extending in a radial direction of the plate member toward the suction port; and a first axial flow passage connected to the first radial flow passage and extending along an axial direction of the plate member, and wherein the first axial flow passage communicates with a space between the outer casing and the intermediate casing.

17. The vertical pump according to claim 14, wherein the high-pressure internal flow passage includes:

an annular flow passage communicating with an outlet of the final stage impeller closest to the casing cover among the multi-stage impellers; and a second radial flow passage outwardly extending in a radial direction of the plate member from the annular flow passage toward the discharge port.

18. The vertical pump according to claim 17, wherein the annular flow passage includes a scroll flow passage having a flow passage cross-sectional area that varies along a circumferential direction of the plate member.

19. The vertical pump according to claim 14, wherein the intermediate casing comprises:

a plurality of sections stacked in an axial direction of the vertical pump and provided so as to surround the multi-stage impellers; and a fastening section located on an opposite side of the casing cover across the plurality of sections in the axial direction, wherein the vertical pump further comprises a plurality of tie bolts each having one end fixed to the plate member constituting the casing cover and the other end fixed to the fastening section, and wherein in addition to the low-pressure internal flow passage and the high-pressure internal flow passage, the plate member has a plurality of bolt holes into which the one end of the plurality of tie bolts are screwed, respectively.

20. The vertical pump according to claim 14, further comprising a thrust balancing part provided at the penetration part of the plate member for the rotary shaft, the plate member constituting the casing cover, wherein the thrust balancing part includes:

the balance sleeve configured to rotate with the rotary shaft, the balance sleeve being attached to an outer periphery of the rotary shaft; and a balance bushing provided on the plate member on an outer peripheral side of the balance sleeve, wherein the intermediate chamber is formed between the plate member and the rotary shaft on an opposite side of the multi-stage impellers across the thrust balancing part in the axial direction of the vertical pump, and wherein a balance internal flow passage is formed in the plate member so as to communicate the intermediate chamber with the intermediate stage impeller of the multi-stage impellers.

21. The vertical pump according to claim 1, wherein the discharge pressure of the vertical pump is 10 MPa or more.

22. The vertical pump according to claim 1, wherein the vertical pump is an ammonia pump for pressurizing a raw material ammonia in a urea synthesis plant or a carbamate pump for pressurizing a carbamate that is intermediate in the urea synthesis plant.

* * * * *